US005971656A

United States Patent [19]

Kitsmiller

[11] Patent Number: 5,971,656

[45] Date of Patent: Oct. 26, 1999

[54] PERVIOUS PAVEMENT INSTALLATION

[76] Inventor: Thomas Edward Kitsmiller, 3130 Water Front Dr., Chattanooga, Tenn. 37406

[21] Appl. No.: 09/039,407

[22] Filed: Mar. 16, 1998

[51] Int. Cl.[6] ..... E01C 7/00

[52] U.S. Cl. ..... 404/74; 404/75; 404/106; 249/4

[58] Field of Search ..... 404/74, 75, 85, 404/106, 122, 128, 72; 249/2, 4, 5

[56] References Cited

U.S. PATENT DOCUMENTS 3,767,312 10/1973 Raymond et al. ..... 404/106

*Primary Examiner*—James A. Lisehora

[57] ABSTRACT

A hot-mix motorized paver is used to deliver fresh pervious pavement mix to form one or more lanes of pavement. The paver is supported on ski-type support runners on parallel side forms. A compacting roller is connected to the paver and rolls along the top of each side form to compact the fresh pavement down to the top of the forms. Indentations are cut into the fresh compacted pavement by rolling a hand powered roller, containing a pointed hoop, across the fresh pavement at select locations to form expansion joints. The pavement is covered with polyethylene sheeting within 20 minutes after completion of placement and finishing, the sheeting is removed after a curing time of approximately seven days, and a concrete saw is used to remove excess pervious pavement that extends beyond the desired paved area.

2 Claims, 3 Drawing Sheets

PERVIOUS PAVEMENT INSTALLATION

BACKGROUND OF THE INVENTION

In recent years, stormwater run-off has become a greater problem with developing areas, thus a desirable method of controlling surface water was needed. Portland Cement Pervious Pavement was developed, which is a mixture of course aggregate, cement, admixtures and water, and when installed as pavement, allows water and air to pass down through said pavement into a water drainage system beneath, and while supplying a desirable method of controlling surface water and various environmental drainage problems, it provides a structural pavement for auto traffic, such as roads or parking areas. This invention contributes to an efficient time-saving method of installing Pervious Pavement, thereby creating a large savings in construction costs.

SUMMARY OF THE INVENTION

The purpose of this invention is to provide a method for installing and finishing Pervious Pavement in a very efficient and time-saving procedure, thereby reducing the cost of construction substantially.

Various other features of the method of the present invention will become obvious to those skilled in the art upon reading the disclosure set forth hereinafter.

BRIEF DESCRIPTION OF DRAWINGS

Referring now to the drawings, the system is shown in isometric views of the equipment, project preparation and the finished project.

DETAILED DESCRIPTION

Figures 1, 2:
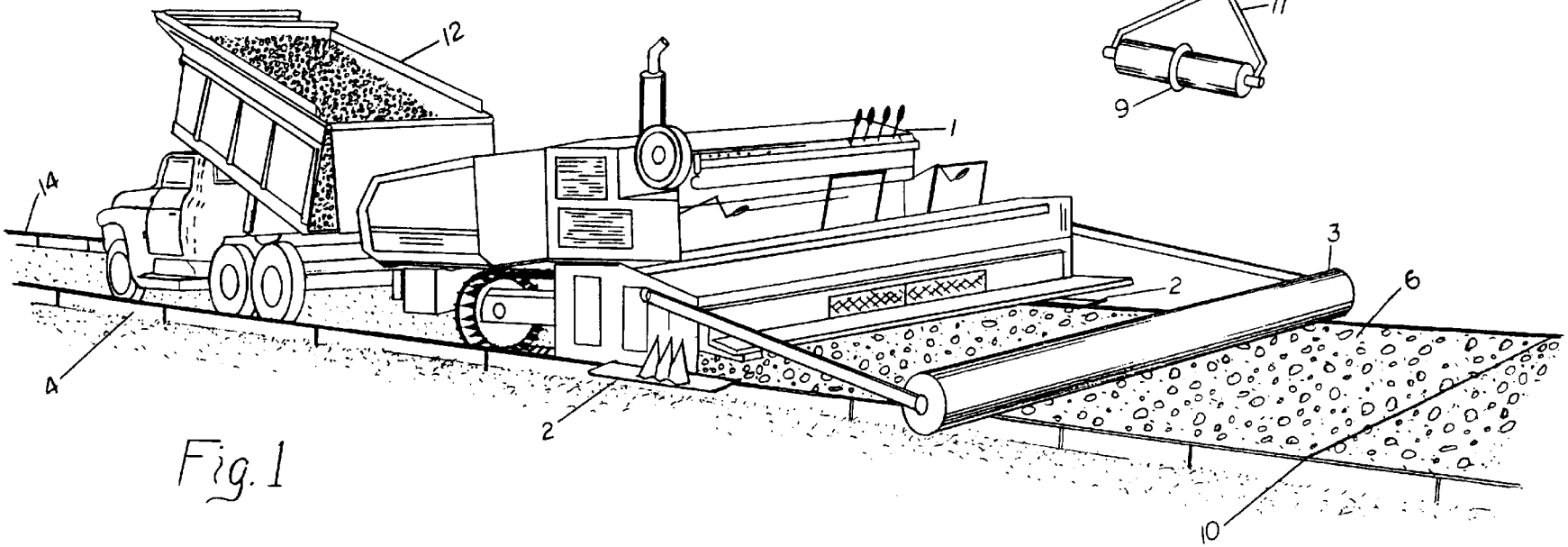
FIG. 1 illustrates equipment used for transporting and paving the Pervious Pavement.
FIG. 2 illustrates equipment used to groove the paved Pervious Pavement, for expansion joints.

Referring now to FIG. 1, there is illustrated a hot-mix motorized paving machine 1 that has been altered with the addition of adjustable support runners 2, (having ski type designs) attached to each end of the paver's screed, to support the screed's level, thereby controlling the surface level of the Pervious Pavement and its thickness. Two forms 4 and 14, having predetermined lengths, are installed parallel and separated by the width needed for the lane being paved and each positioned to vertically span the desired depth of the compacted Pervious Pavement and sufficient in stability and strength to guide and support the hot-mix paver 1, at its support runners 2. Also attached to the hot-mix paver 1, is a long compacting roller 3, positioned parallel to the paver's width, and has each of its ends connected, by connectors, to the rear side of the paver respectively. The compacting roller is sufficient in length to extend across the area between the parallel forms 4 and 14 and rest on the top of each. It is then positioned to be drawn by the paver to roll and compact the allotted surplus, of the freshly poured Pervious Pavement mix, left by the height adjustment of the paver's screed, above the forms, down to the top of forms 4 and 14, the desired level previously established by the positioning of the forms 4 and 14. Dump truck 12 illustrates the delivery of the Pervious Pavement mix to the hot-mix paver, as it paves lane 6 of Pervious Pavement, using parallel forms 4 and 14 as guides and support.

FIG. 2 illustrates a hand powered roller 11, containing a hoop 9, located at its center. The hoop 9 extends outward from the roller to a point, that allows it to cut an indentation 10, when the roller is rolled over the freshly poured pavement, thereby creating expansion joints.

Figures 3, 4:
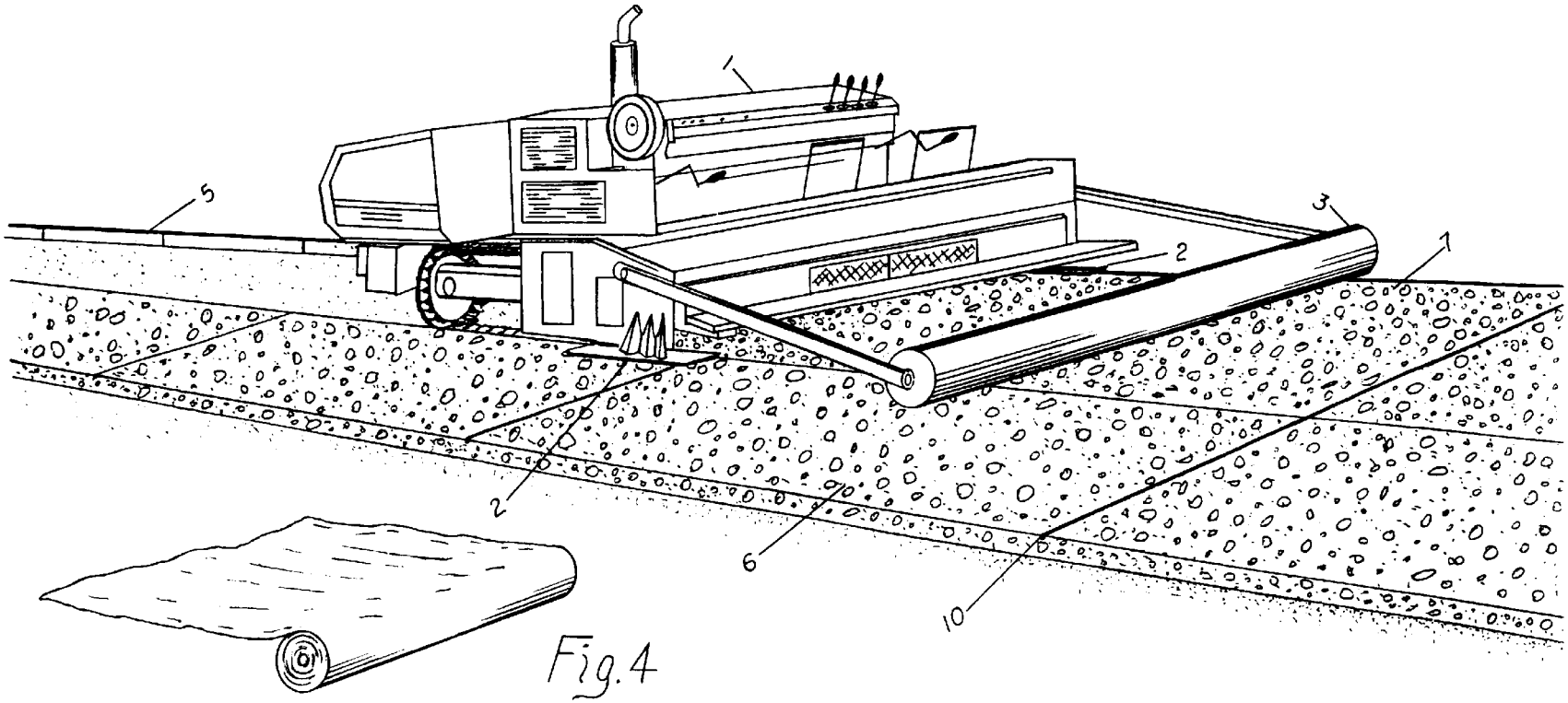
FIG. 3 illustrates equipment, as it is used to pave parallel adjoining lanes of Pervious Pavement.
FIG. 4 illustrates the material used to prolong the curing time of the Pervious Pavement to approximately seven days.

FIG. 4 illustrates a roll of polyethylene sheeting that is used to immediately cover the Pervious Pavement after placement and finishing, to allow for proper curing time of approximately seven days.

FIG. 3 illustrates lane 6 having been paved with Pervious Pavement and cured sufficiently to allow removal of its polyethylene sheeting and its forms 4 and 14, and illustrates form 5 positioned parallel to lane 6 but separated from lane 6 by a selected distance. Hot-mix motorized paver 1 is illustrated paving lane 7 by using the top edge of lane 6 and the top of form 5 for support of its adjustable support runners 2 and its compacting roller 3, thus spanning the width of two adjacent lanes (6 and 7) with freshly poured Pervious Pavement.

Figure 5:
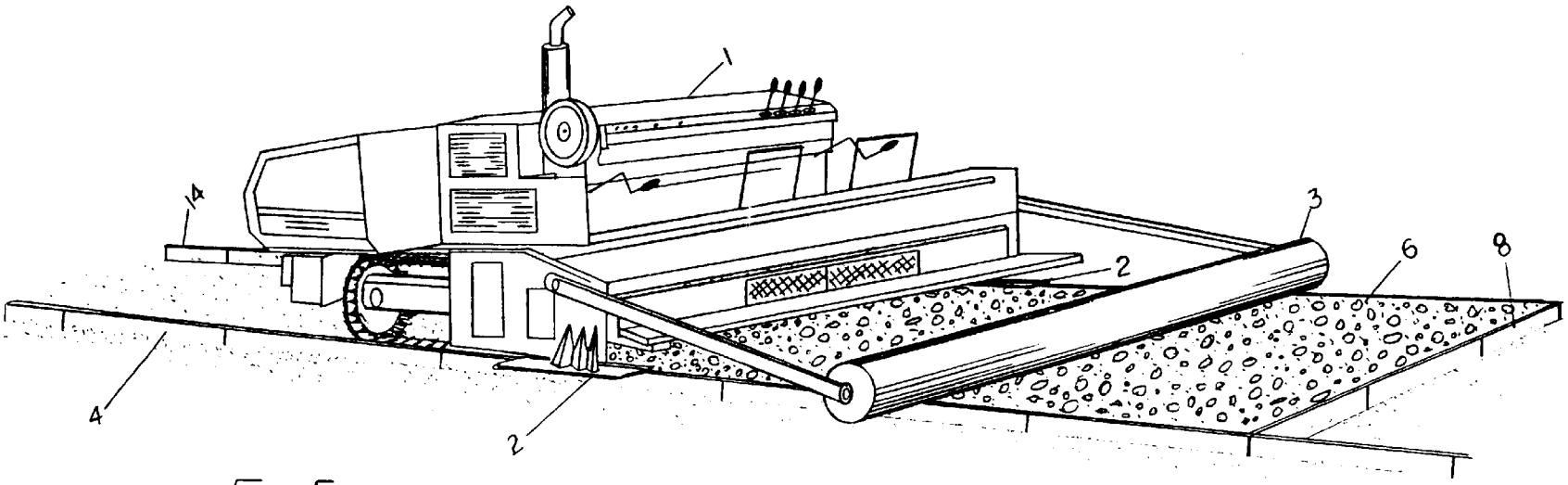
FIG. 5 illustrates the position of the transversal form for the beginning of the pavement of a lane and the end of said lane.

FIG. 5 illustrates the positioning of transversal form 8 across and between the parallel forms 4 and 14, and being equal in height and strength and with each of its ends connected to forms 4 and 14 respectively. The function of form 8 is to support the fresh Pervious Pavement mix at the beginning of the paver's paving of a lane of Pervious Pavement. At the opposite end of the lane of Pervious Pavement being paved, the parallel forms 4 and 14 are left open and without a form positioned across between the parallel forms 4 and 14, thus allowing the paver to pave to the selected lane's end without interference. Any surplus Pervious Pavement extending beyond the desired lane's end is removed, after sufficient curing, with the use of a concrete saw.

Upon determining the desired length, width and thickness of the Pervious Pavement in lane 6, parallel forms 4 and 14 are installed to border the sides of the desired length and width of lane 6 and to vertically span the desired thickness of the compacted Pervious Pavement. Transversal form 8 is constructed at the beginning point of the paving of lane 6, and positioned between forms 4 and 14 and is connected to each respectively and is equal to their height and strength. Hot-mix paver 1, being motorized, has its screed positioned at form 8, the beginning point of lane 6, and travels between the parallel forms 4 and 14 and with its screed's support runners 2, adjusted to guide its level as they move along the top of parallel forms 4 and 14, the fresh Pervious Pavement mix, delivered to the hot-mix paver by truck, is evenly spread by the paver's screed to the desired thickness, which is above parallel forms 4 and 14, to allow for the predetermined compaction of the pavement down to the top of parallel forms 4 and 14, as the paver rolls its compacting roller 3 along the tops of forms 4 and 14, to complete compaction. After compaction of the Pervious Pavement, hand powered roller 11 (FIG. 2), with its hoop 9, is rolled across lane 6, at selected locations, to cut expansion joint indentations 10. Immediately after completion, but within the first 20 minutes, the fresh Pervious Pavement is covered by the FIG. 4 polyethylene sheeting, to allow for approximately seven days of curing, at which time the polyethylene sheeting and forms 4, 14 and 8 can be removed. Also after sufficient curing, any surplus Pervious Pavement extending beyond the predetermined end of lane 6 can be removed with the use of a concrete saw.

Upon completion of the paving of lane 6, if additional paving is desired adjacent to lane 6, a single form 5 is then installed for lane 7, and positioned parallel to lane 6, but separated in distance equal to the selected width, and positioned to span the desired length and thickness of the compacted pavement, and is connected to the edge of lane 6 with a transversal form, thus establishing the beginning point for the pavement of lane 7. Hot-mix paver 1, being motorized, travels between the edge of lane 6 and the parallel form 5 and with its screed's support runners 2, adjusted to guide its level, as they move along the top edge of lane 6 and the top of form 5 respectively, the fresh Pervious Pavement mix, delivered to the hot-mix paver by truck, is evenly spread by the paver's screed to the desired thickness, which is between and above the top edge of lane 6 and the top of form 5, to allow for the predetermined compaction of the pavement down to the top of the top edge of lane 6 and the top of form 5, as the paver rolls its compacting roller 3 along the top edge of lane 6 and the top of form 5, to complete compaction of the pavement. After compaction, the hand powered roller 11, with its hoop 9, is rolled across lane 7, at selected locations, to cut expansion joint indentations. Additional adjacent lanes can be paved in like manner to the paving of lanes 6 and 7.

Immediately but not later than 20 minutes after placement and finishing the Pervious Pavement, polyethylene sheeting (FIG. 4) is used to cover the fresh pavement to allow proper curing time of approximately seven days.

It is to be understood that the foregoing drawings and description of the invention is to be taken as a preferred embodiment and that various other modifications will occur to those skilled in the art upon reading the disclosure, however all changes and modifications that come within the spirit of the invention are desired to be protected.

I claim:

1. A method of installing and finishing Portland Cement Pervious Pavement with a very efficient, time-saving procedure, comprising the steps of (1). constructing, at desired locations, two parallel forms, spaced apart and sufficient in stability and strength to support the mechanical equipment, and being the length and depth of the finished compacted pavement, (2). constructing a transversal form, positioned to connect the two parallel forms and equal in their strength and height and located at the beginning point of the pavement area, (3). positioning a hot-mix motorized paver between the parallel forms and positioning its screed against the transversal form, (4). installing on each end of the hot-mix paver's screed, adjustable ski-type support runners, positioned for each support runner to rest on and move along the top of its respective form, for supporting the screed's height and level, as the paver moves between the parallel forms and performs its paving functions, (5). installing behind the hot-mix paver, a compacting roller, positioned parallel to the paver's width and having each of its ends connected, by connectors, to the paver's rear side respectively, for power movement, and being sufficient in length to span the area between the parallel forms and rest and roll along the top of each form, (6). delivering fresh Pervious Pavement mix into the hot-mix paver's hopper, (7). delivering the fresh Pervious Pavement mix through the paver and under its leveled screed at a selected level across the area between the parallel forms and at the selected height above the parallel forms that allows the compacting roller's function to compact the fresh Pervious Pavement down to the top of the parallel forms, (8). cutting indentations across the fresh compacted pavement by rolling the hand powered roller, containing a pointed hoop, across the fresh pavement at selected locations, for expansion joints, (9). covering the fresh Pervious Pavement, within 20 minutes after completion of placement and finishing, with polyethylene sheeting, to allow for the proper curing time of approximately seven days, (10). removing the polyethylene sheeting, the parallel forms and the transversal form from the lane of Pervious Pavement, after proper curing time of approximately seven days, (11). removing, from the end of the paved area, any excess Pervious Pavement that extends beyond the desired paved area by the use of a concrete saw, thus completing the paving of a lane of Pervious Pavement.

2. A method of installing and finishing Portland Cement Pervious Pavement with a width of at least two lanes, with a very efficient, time-saving procedure, comprising the steps of (1). constructing, at desired locations, two parallel forms, spaced apart and sufficient in stability and strength to support the mechanical equipment, and being the length and depth of the finished compacted pavement, (2). constructing a transversal form, positioned to connect the two parallel forms and equal in their strength and height and located at the beginning point of the pavement area, (3). positioning a hot-mix motorized paver between the parallel forms and positioning its screed against the transversal form, (4). installing on each end of the hot-mix paver's screed, adjustable ski-type support runners, positioned for each support runner to rest on and move along the top of its respective form, for supporting the screed's height and level, as the paver moves between the parallel forms and performs its paving functions, (5). installing behind the hot-mix paver, a compacting roller, positioned parallel to the paver's width and having each of its ends connected, by connectors, to the paver's rear side respectively, for power movement, and being sufficient in length to span the area between the parallel forms and rest and roll along the top of each form, (6). delivering fresh Pervious Pavement mix into the hot-mix paver's hopper, (7). delivering the fresh Pervious Pavement mix through the paver and under its leveled screed at a selected level across the area between the parallel forms and at the selected height above the parallel forms that allows the compacting roller's function to compact the fresh Pervious Pavement down to the top of the parallel forms, (8). cutting indentations across the fresh compacted pavement by rolling the hand powered roller, containing a pointed hoop, across the fresh pavement at selected locations, for expansion joints, (9). covering the fresh Pervious Pavement, within 20 minutes after completion of placement and finishing, with polyethylene sheeting, to allow for the proper curing time of approximately seven days, (10). removing the polyethylene sheeting, the parallel forms and the transversal form from the lane of Pervious Pavement, after proper curing time of approximately seven days, (11). removing, from the end of the paved area, any excess Pervious Pavement that extends beyond the desired paved area by the use of a concrete saw, thus completing the paving of a lane of Pervious Pavement, (12). installing a single form parallel to the edge of the previously paved lane, but spaced apart and sufficient in stability and strength to support the mechanical equipment and being the length and depth of the finished compacted pavement, (13). constructing a transversal form, positioned to connect the single parallel form to the edge of the previously paved lane of Pervious Pavement and equal in strength, stability and depth to the single parallel form and located at the beginning point of the desired pavement area adjacent to the previously paved lane, (14). positioning the hot-mix paver between the previously paved lane and the single parallel form and positioning its screed against the transversal form, thus using the parallel form and the edge of the previously paved lane, as the forms for the adjacent lane to be paved, with the paver's support runners and its compacting roller, positioned to rest and function on the top edge of the previously paved lane and on the top of the single parallel form respectively, during the paver's function of paving, (15). delivering fresh Pervious Pavement mix into the hot-mix paver's hopper, (16). delivering the fresh Pervious Pavement mix through the paver and under its leveled screed at a selected level across the area between the edge of the previously paved lane and the parallel single form and at the selected height above the previously paved lane and the parallel single form that allows the compacting roller's function to compact the fresh Pervious Pavement down to the top of the previously paved lane and the parallel single form respectively, (17). cutting indentations across the fresh compacted pavement, of this adjacent lane, by rolling the hand powered roller, containing a pointed hoop, across the fresh pavement, at selected locations, for expansion joints, (18). convering the fresh Pervious Pavement, within 20 minutes after completion of placement and finishing, with polyethylene sheeting, to allow for the proper curing time of approximately seven days, (19). removing the polyethylene sheeting, the single parallel form and the transversal form from this adjacent lane of Pervious Pavement, after proper curing time of approximately seven days, (20). removing from the end of this adjacent paved lane any excess Pervious Pavement that extends beyond the desired paved area by the use of a concrete saw, thus completing the paving of two adjacent lanes of Pervious Pavement.

* * * * *